US006868784B2

(12) United States Patent
Saito

(10) Patent No.: US 6,868,784 B2
(45) Date of Patent: Mar. 22, 2005

(54) FORM ROLLER APPARATUS FOR PRINTING PRESS

(75) Inventor: Nobuaki Saito, Ibaraki (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 10/778,372

(22) Filed: Feb. 12, 2004

(65) Prior Publication Data

US 2004/0163560 A1 Aug. 26, 2004

(30) Foreign Application Priority Data

Feb. 20, 2003 (JP) ..... 2003-042179

(51) Int. Cl.[7] ..... B41F 31/00

(52) U.S. Cl. ..... 101/350.3; 101/216; 101/DIG. 38; 492/15

(58) Field of Search ..... 101/350.3, DIG. 38, 101/216, 147, 148, 248; 492/15, 45; 29/895

(56) References Cited

U.S. PATENT DOCUMENTS 3,986,452 A * 10/1976 Dahlgren ..... 101/148
4,214,527 A * 7/1980 Kamota ..... 101/247
4,739,703 A 4/1988 Eguchi
4,741,266 A * 5/1988 Stirbis et al. ..... 101/40
4,785,514 A 11/1988 Kannwischer
4,829,645 A 5/1989 Kannwischer
4,869,167 A 9/1989 Villarreal
4,887,533 A 12/1989 Lemaster et al.
4,953,462 A * 9/1990 Krober ..... 101/216
5,570,633 A * 11/1996 Schultz et al. ..... 101/182

* cited by examiner

*Primary Examiner*—Eugene H. Eickholt
(74) *Attorney, Agent, or Firm*—Blakely Sokoloff Taylor & Zafman

(57) ABSTRACT

A form roller apparatus for a printing press includes an ink form roller, compression coil spring, bolt, and U-groove. The ink form roller is in contact with an oscillating roller, and slides in an axial direction to follow motion of the oscillating roller in an axial direction. The ink form roller has a roller shaft which is supported rotatably and a roller main body which is supported to be movable in the axial direction of the roller shaft. The compression coil spring biases the roller main body in the axial direction. The bolt moves forward/backward in a radial direction at an end of the roller shaft. The U-groove is provided to the roller main body and is engaged by the bolt to regulate slide motion of the ink form roller in the axial direction.

10 Claims, 6 Drawing Sheets

FORM ROLLER APPARATUS FOR PRINTING PRESS

BACKGROUND OF THE INVENTION

The present invention relates to a support apparatus for a form roller in a printing press.

In an offset printing press, sometimes, a blurred portion appears in part of a solid printing area, that is, a printing trouble so-called ghost occurs. As a countermeasure for preventing the ghost, in a conventional roller support apparatus, a compression coil spring is interposed in an ink form roller. The ink form roller is slid in the axial direction by utilizing the frictional force with respect to an oscillating roller which is in contact with the ink form roller.

U.S. Pat. No. 4,739,703 proposes an inking apparatus in which an ink form roller is constituted by a roller shaft, a roller main body fitted on the roller shaft to be rotatable and slidable in the axial direction, an oscillating stroke adjusting member threadably engaging with the roller shaft, and a compression coil spring resiliently interposed between the oscillating stroke adjusting member and roller main body.

In the conventional roller support apparatus described above, after the ghost countermeasure is taken making allowing the ink form roller to be slidable in the axial direction, the slide motion of the ink form roller in the axial direction must be regulated. Therefore, after the ghost countermeasure is taken, the oscillating stroke adjusting member is screwed in to compress the compression coil spring, so that the resilience of the compression coil spring is regulated.

With a pattern that does not require a ghost countermeasure, if the ink form roller is slid in the axial direction, contamination caused by ink attaching to a non-image area, that is, scumming occurs. In this case, the slide motion of the ink form roller in the axial direction must also be regulated. Therefore, with a pattern that does not require a ghost countermeasure, the oscillating stroke adjusting member is screwed in to compress the compression coil spring thoroughly, so that the resilience of the compression coil is regulated.

The operation of screwing in the oscillating stroke adjusting member against the resilient force to a position where the resilience of the compression coil spring is regulated requires a large screwing force. This poses a heavy load on the operator. As the oscillating stroke adjusting member is screwed in, the roller shaft which is supported rotatably also rotates undesirably, resulting in poor workability. To solve these problems, the roller shaft must be removed from the printing press temporarily, and then the screwing operation must be performed. When the operation is ended, the roller shaft must be attached to the printing press again. As a result, the operation becomes cumbersome, and a long operating time is needed.

SUMMARY OF THE INVENTION

It is an object of the present invention to provide a form roller apparatus for a printing press in which the workability is improved.

It is another object of the present invention to provide a form roller apparatus for a printing press in which the operating time is shortened.

In order to achieve the above objects, according to the present invention, there is provided a form roller apparatus for a printing press, comprising a form roller which is in contact with an oscillating roller and slides in an axial direction to follow motion of the oscillating roller in the axial direction, the form roller having a roller shaft which is supported rotatably and a roller main body which is supported to be movable in the axial direction of the roller shaft, biasing means for biasing the roller main body in the axial direction, a locking member which moves forward/backward in a radial direction at an end of the roller shaft, and a to-be-engaged portion which is provided to the roller main body and to be engaged by the locking member to regulate slide motion of the form roller in the axial direction.

DESCRIPTION OF THE PREFERRED EMBODIMENT

A form roller apparatus for a printing press according to an embodiment of the present invention will be described with reference to FIGS. 1 to 6.

Figure 7:
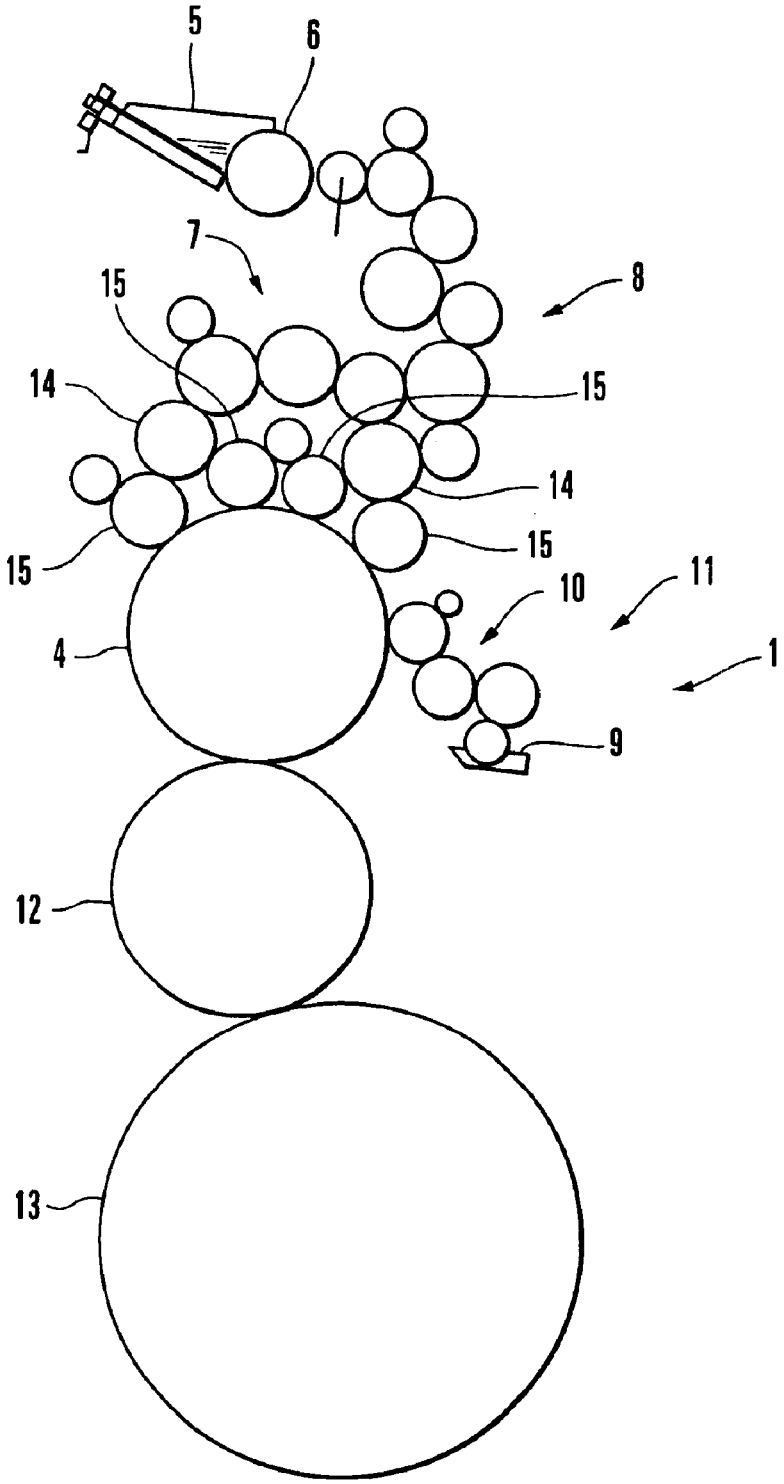
FIG. 7 is a view showing cylinder arrangement of a rotary printing press to which the form roller apparatus according to the present invention is applied.

As shown in FIG. 7, a printing unit 1 in a printing press has a plate cylinder 4 having a surface on which a plate is mounted, an inking device 8 constituted by an ink fountain 5 for storing ink and a roller group 7 of a large number of rollers including a fountain roller 6 which supplies the ink in the ink fountain 5 to the plate cylinder 4, and a dampening unit 11 constituted by a water pan 9 for storing dampening water and a roller group 10 of a plurality of rollers. A blanket cylinder 12 is in contact with the plate cylinder 4. An impression cylinder 13 is in contact with the blanket cylinder 12.

Two oscillating rollers 14 and four ink form rollers 15 are provided on the terminal end side of the roller group 7 of the inking device 8, to be close to the plate cylinder 4. More specifically, the oscillating rollers 14 are axially supported by a pair of opposing frames (not shown) and rotatably driven by a motor, so that they reciprocate in the axial direction at a predetermined period and oscillation width through an oscillating mechanism at the shaft ends. Roller arms (not shown) having bearings 16 (FIG. 3) at their free ends are pivotally supported at the two shaft ends of each oscillating roller 14. The bearings 16 are rotatably, axially supported by a corresponding roller shaft 17, and their motion in the axial direction is regulated by stepped portions 17*a* formed at the two ends of the roller shaft 17, as shown in FIG. 3.

Figure 1:
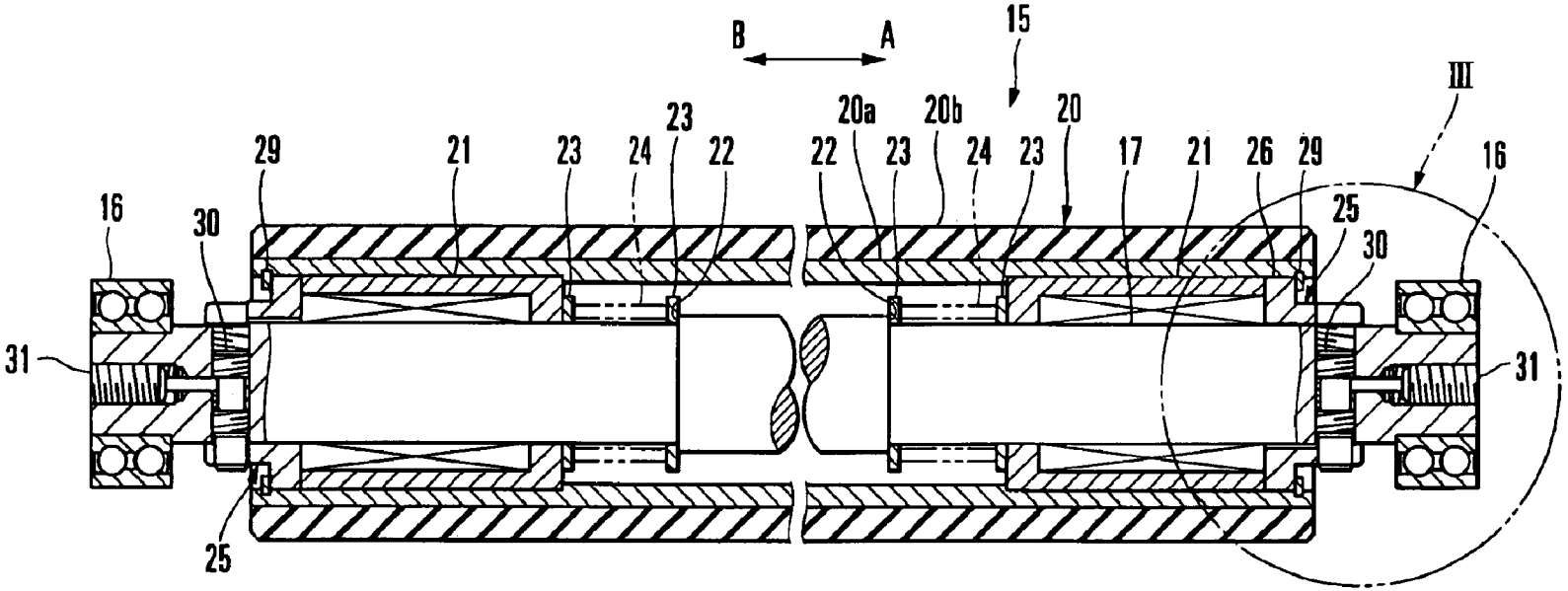
FIG. 1 is a sectional view of a form roller apparatus for a printing press according to an embodiment of the present invention.

As shown in FIG. 1, each ink form roller 15 is constituted by the roller shaft 17, a cylindrical roller main body 20 supported by the roller shaft 17 to be movable in the axial direction, compression coil springs 24 serving as resilient members arranged between the cylindrical portion of the roller main body 20 and the roller shaft 17, and bolts 30 serving as locking members that move forward/backward in the radial direction of the roller shaft 17.

Figure 3:
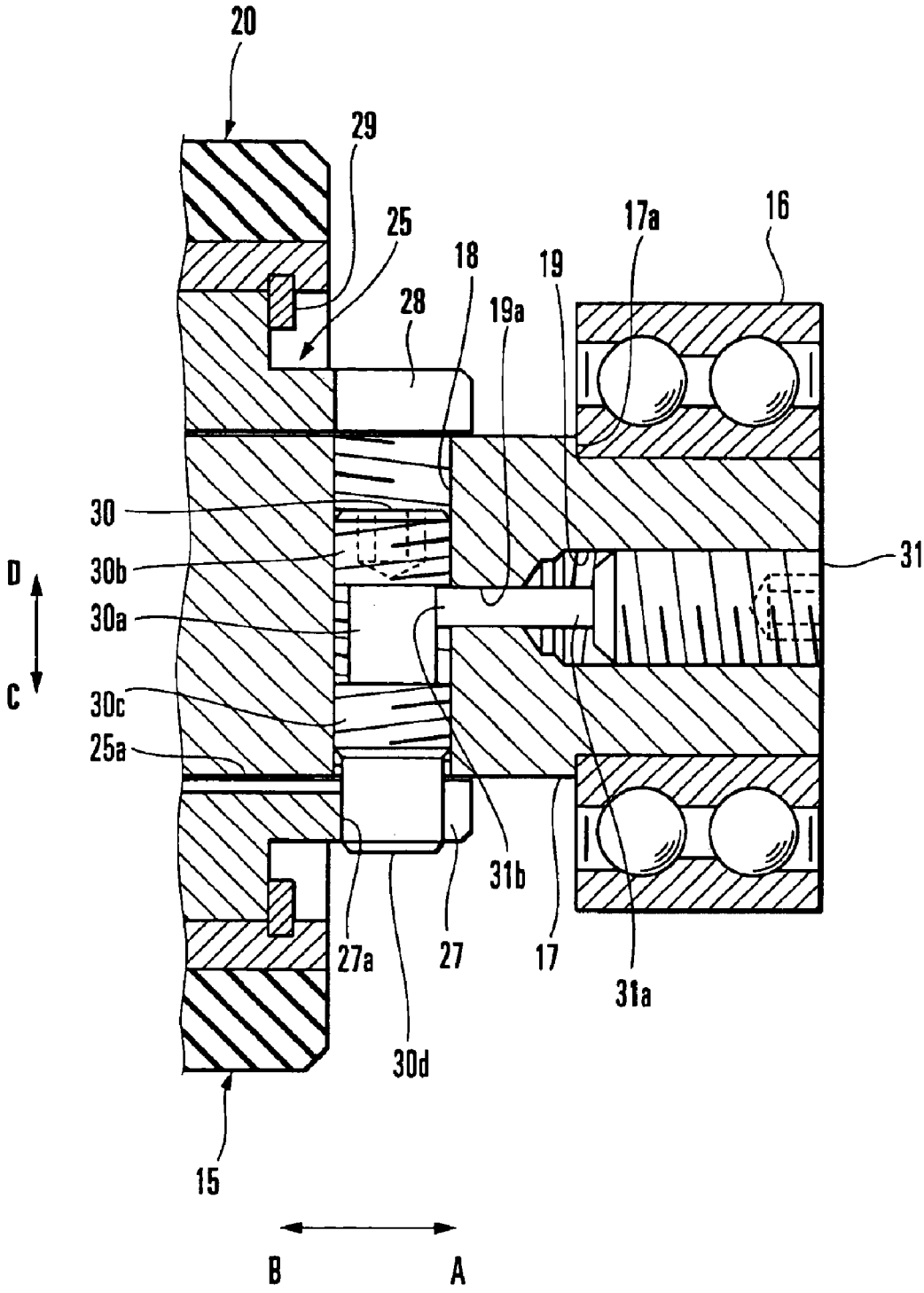
FIG. 3 is an enlarged view of the portion III of FIG. 1 while slide regulation is effective.

As shown in FIG. 3, the roller shaft 17 has screw holes 18, at its two ends, extending through the roller shaft 17 in the radial direction, and screw holes 19, at the centers of the respective ends, extending in the axial direction. The roller shaft 17 has communication holes 19*a* through each of which the corresponding screw hole 19 and screw hole 18 communicate with each other.

As shown in FIG. 1, the roller main body 20 is formed of a cylindrical metal pipe 20*a* and a rubber member 20*b* covering the outer surface of the metal pipe 20*a*. The roller main body 20 is fitted on the roller shaft 17 through a pair of slide bearings 21 fitted in the openings at its two ends. The ends of the roller shaft 17 supported by the slide bearings 21 have a diameter slightly smaller than the large-diameter portion at the center, and a pair of stepped portions 22 are formed between the small-diameter portions and the large-diameter portion. The roller main body 20 is supported by the small-diameter portions of the roller shaft 17 to be movable in the axial direction.

The pair of compression coil springs 24 serving as the resilient members are resiliently mounted, each between that one end of the corresponding slide bearing 21 which is close to the center and the corresponding stepped portion 22 of the roller shaft 17, in a weakly compressed state (a state wherein the resilient force is accumulated). In this arrangement, when the roller main body 20 slides in the axial direction, the pair of compression coil springs 24 are compressed alternately, and regulate the slide motion of the roller main body 20 at an end limit where each compression coil spring 24 is compressed completely. When the roller main body 20 does not slide, the screw holes 18 of the roller shaft 17 expose from the two ends of the roller main body 20, as shown in FIG. 3.

To-be-engaged members 25 are attached to the openings at the two ends of the metal pipe 20*a*. As shown in FIGS. 2A to 2D, each to-be-engaged member 25 is formed of a cylindrical portion 25*a* having two open ends, and a flange 25*b* integrally formed at one open end of the cylindrical portion 25*a*. An inner diameter R1 (FIG. 2D) of the cylindrical portion 25*a* of the to-be-engaged member 25 is slightly larger than the diameter of the roller shaft 17. A diameter R2 (FIG. 2D) of the flange 25*b* is slightly smaller than the inner diameter on the open end side of the metal pipe 20*a*.

The cylindrical portion 25*a* of the to-be-engaged member 25 has two U-grooves 27 and 28 which open to the counter-flange side other end. The U-grooves 27 and 28 are formed at opposing positions. A width W1 (FIG. 2C) of one U-groove 27 as a to-be-engaged portion (hole portion) is slightly larger than the diameter of a locking portion 30*d* of the corresponding bolt 30 (to be described later). The width of the other U-groove 28 as the to-be-engaged portion is larger than the outer diameter of the corresponding bolt 30.

Figure 2A:
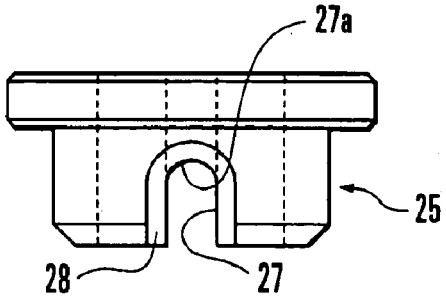
FIGS. 2A to 2C are rear, plan, and front views, respectively, of the to-be-engaged member shown in FIG. 1.
Figure 2B:
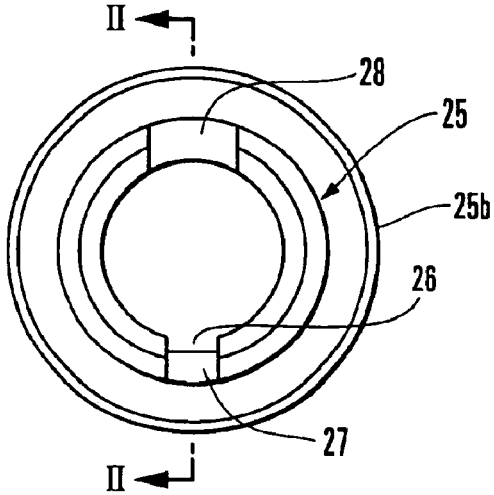
Figure 2C:
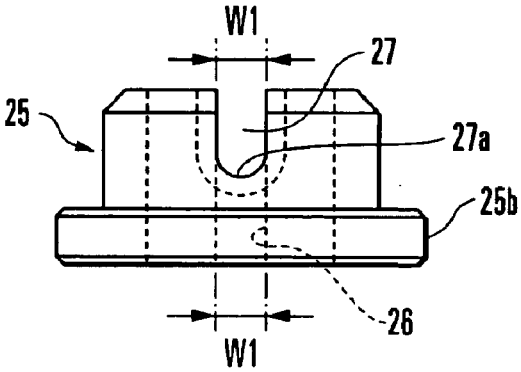
Figure 2D:
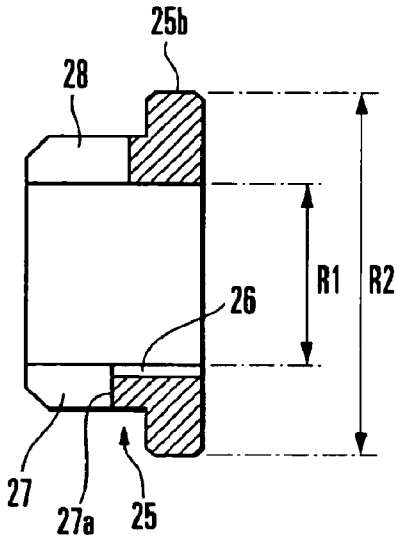
FIG. 2D is a sectional view taken along the line II—II of FIG. 2B.

A guide groove 26 is formed in part of the inner surface of the to-be-engaged member 25, as shown in FIGS. 2B and 2D. The guide groove 26 is formed to have the same width as the width W1 of the U-groove 27. As shown in FIG. 2B, the guide groove 26 is formed to overlap the U-groove 27 in the circumferential direction, and extends from the bottom of the U-groove 27 to the flange-side opening of the to-be-engaged member 25, as shown in FIG. 2D.

As shown in FIG. 1, with the roller shaft 17 being inserted, the flanges 25*b* of the to-be-engaged members 25 fit in the metal pipe 20*a* of the roller main body 20. The to-be-engaged members 25 are clamped by the slide bearings 21 and ring members 29, respectively, and are accordingly attached to the roller main body 20 such that their motion in the axial direction is regulated. The U-grooves 27 and 28 of the to-be-engaged members 25 joined in this manner expose from the two ends of the roller main body 20, as shown in FIG. 3, and the guide groove 26 extends in the direction of arrows A–B.

Each bolt 30 serving as the locking member has a small-diameter portion 30*a*, having no threaded portion, at its substantial center in the axial direction. The threaded portion of the bolt 30 is separated into an operation-side threaded portion 30*b* and distal end-side threaded portion 30*c* by the small-diameter portion 30*a*. The small circular cylindrical locking portion 30*d* integrally projects from the distal end of the distal end-side threaded portion 30*c*. The bolt 30 is first inserted in the U-groove 28 of the to-be-engaged member 25, is threadably engaged by the corresponding screw hole 18 of the roller shaft 17, and is moved forward in the direction of an arrow C in FIG. 3. Hence, the locking portion 30*d* fits in the U-groove 27 of the to-be-engaged member 25 and engages with a bottom 27*a* of the U-groove 27. The locking portion 30*d* may have a taper at its distal end edge to correspond to the width of the U-groove 27.

In this manner, when the locking portion 30*d* of the bolt 30 engages with the bottom 27*a* of the U-groove 27 of the to-be-engaged member 25, the motion of the roller main body 20 in the direction of the arrow A is regulated through the to-be-engaged member 25. Similarly, at the other end of the roller main body 20, the bolt 30 regulates the motion of the roller main body 20 in the direction of the arrow B. Thus, the motion of the roller main body 20 in the axial direction (the direction of the arrows A–B) is regulated (stopped).

As shown in FIG. 3, each spring plunger 31 threadably engages with the screw hole 19 of the roller shaft 17 and has a plunger 31*a* which is biased in a projecting direction (the direction of the arrow B) by the biasing force of a spring (not shown). When the spring plunger 31 is threadably engaged with the screw hole 19, the plunger 31*a* extends through the communication hole 19*a*, and its distal end 31*b* faces the interior of the screw hole 18. Thus, the distal end 31*b* enters the small-diameter portion 30*a* between the threaded portions 30*b* and 30*c*. When the bolt 30 moves forward/backward, the threaded portions 30*b* and 30*c* having diameters larger than that of the small-diameter portion 30*a* abut against the distal end 31*b*, and the locking portion 30*d* is positioned. In FIG. 3, the distal end 31*b* abuts against the small-diameter portion 30*a* of the bolt 30, and engages with the lower end of the threaded portion 30*b*.

Figure 4:
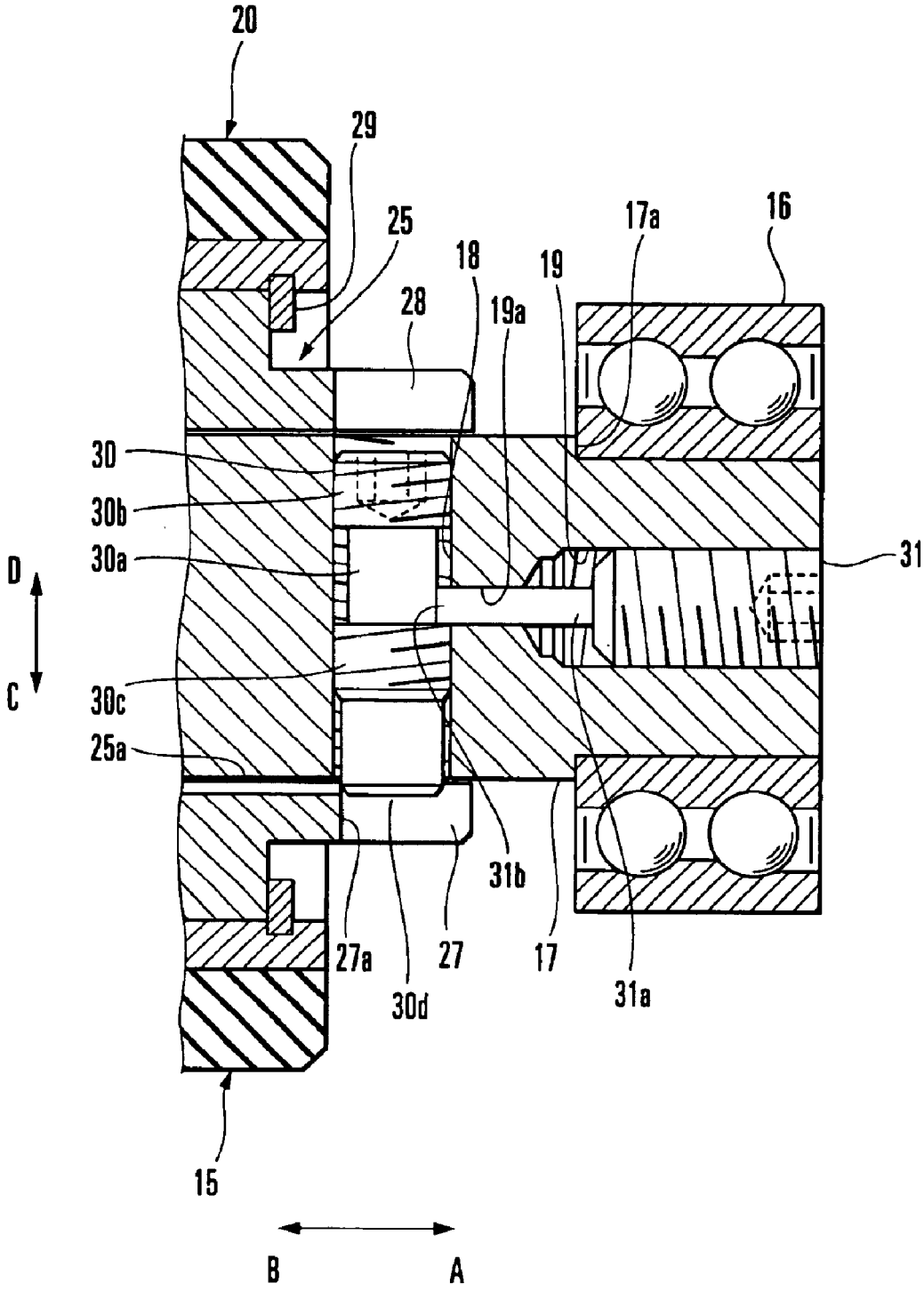
FIG. 4 is a view showing a state wherein slide regulation is canceled.

In this state, the bolt 30 is moved backward in the direction of an arrow D, and the distal end side threaded portion 30*c* engages with the distal end 31*b* of the plunger 31*a*. The locking portion 30*d* of the bolt 30 and the bottom 27*a* of the U-groove 27 of the to-be-engaged member 25, which have been engaging with each other, are disengaged, and the locking portion 30*d* engages with the guide groove 26 of the to-be-engaged member 25, as shown in FIG. 4. As described above, since the width W1 of the guide groove 26 is slightly larger than the diameter of the locking portion 30*d* of the bolt 30, and the guide groove 26 extends in the axial direction of the ink form roller 15, i.e., in the direction of the arrows A–B, the locking portion 30*d* can slide in the guide groove 26 in the direction of arrows A–B. Hence, the roller main body 20 can move in the axial direction (the direction of the arrows A–B).

In this manner, the plunger 31*a* of the spring plunger 31 and the operation side threaded portion 30*b* and distal end side threaded portion 30*c* of the bolt 30 constitute a positioning means that positions the locking portion 30*d* of the bolt 30 at the first position (the position shown in FIG. 3) to engage with the bottom 27*a* of the U-groove 27 of the to-be-engaged member 25, and at the second position (the position shown in FIG. 4) to be disengaged from the bottom 27*a* of the U-groove 27 and to engage with the guide groove 26. This positioning means positions the bolt 30 at the two positions easily and reliably. Simultaneously, the plunger 31*a* of the spring plunger 31 and the operation side threaded portion 30*b* and distal end side threaded portion 30*c* of the bolt 30 cooperate with each other so that the bolt 30 can be prevented from dropping from the screw hole 18 into the printing press. As a result, troubles of the printing press can be prevented.

When the bolt 30 is moved backward in the direction of an arrow D, the locking portion 30*d* and guide groove 26 are held to engage with each other, and the rotation of the to-be-engaged member 25 with respect to the roller shaft 17 is held regulated. Therefore, no difference in phase is present between the rotational direction of the locking portion 30*d* and that of the U-groove 27 of the to-be-engaged member 25, and the locking portion 30*d* and the U-groove 27 of the to-be-engaged portion 25 are always maintained to oppose each other. Hence, when the bolt 30 is moved forward next in the direction of the arrow C for the purpose of regulating the motion of the roller main body 20 in the axial direction, the locking portion 30*d* engages with the U-groove 27 smoothly within a short period of time.

No difference in phase is present between the rotational direction of the bolt 30 threadably engaged in the screw hole 18 of the roller shaft 17 and that of the to-be-engaged member 25, and the operation side threaded portion 30*b* of the bolt 30 and the U-groove 28 of the to-be-engaged member 25 always oppose each other. Hence, the operation of inserting a tool in the U-groove 28 and moving the bolt 30 forward/backward becomes easily. Even if the roller main body 20 is dislocated in the axial direction, it only needs to be moved in the axial direction. The roller main body 20 need not be rotated in order that the operation side threaded portion 30*b* and U-groove 28 oppose each other with their rotary phases coinciding with each other. The workability is thus improved. In this manner, not only the operability of the switching operation of regulating the motion of the roller main body 20 in the axial direction can be improved, but also the operation can be performed smoothly within a short period of time.

The printing operation of the form roller apparatus for the printing press having the above arrangement will be described.

First, the bolt 30 is formed forward in the direction of the arrow C, and the locking portion 30*d* is so fitted in the U-groove 27 of the to-be-engaged member 25 as to engage with the bottom 27*a* of the U-groove 27. Thus, the motion of the roller main body 20 in the axial direction (the direction of the arrows A–B) is regulated (stopped). In this state, printing is started.

When a ghost has occurred during printing due to the pattern to be printed, the driving operation of the printing press is stopped temporarily. Each bolt 30 is moved backward in the direction of the arrow D. The locking portion 30*d* is positioned at the position shown in FIG. 4 to disengage from the bottom 27*a* of the U-groove 27. The locking portion 30*d* is then engaged with the guide groove 26. Thus, the locking portion 30*d* can slide in the guide groove 26 in the direction of the arrows A–B, and the roller main body 20 can move in the axial direction (the direction of the arrows A–B).

Figure 5:
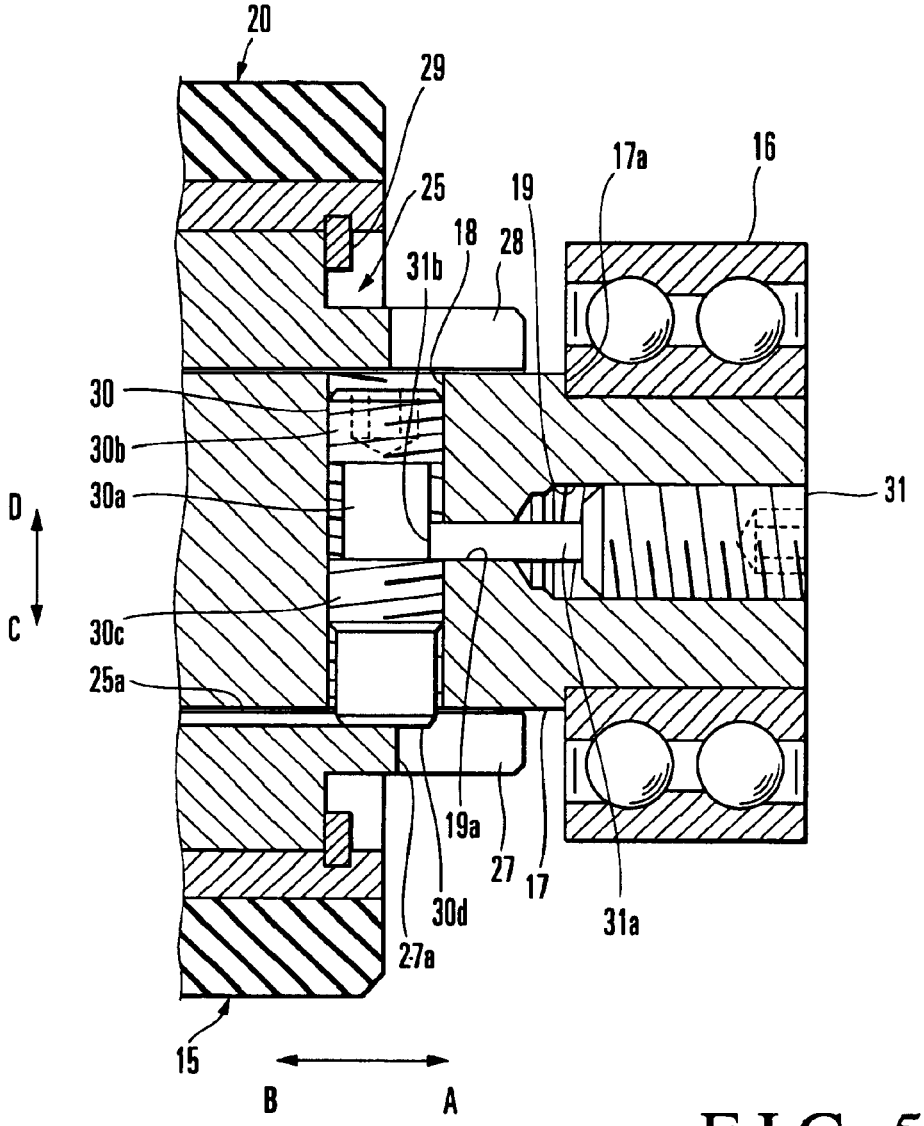
FIG. 5 is a view showing a state wherein a form roller slides while slide regulation is canceled.

In this state, when the printing press is driven again, the oscillating roller 14 slides in the axial direction while it is driven to rotate by the motor. The roller main body 20 of the ink form roller 15 in contact with the oscillating roller 14 also rotates together with the roller shaft 17 due to friction with the oscillating roller 14, as shown in FIG. 5, while sliding in the axial direction on the roller shaft 17. When the roller main body 20 slides, it reciprocates while compressing the pair of compression coil springs 24 alternately, so that impact at the oscillating end is moderated. When the compression coil springs 24 are compressed thoroughly, the motion of the roller main body 20 is regulated. After that, only the oscillating roller 14 oscillates horizontally.

In this manner, to regulate the slide motion of the ink form roller 15 and to cancel the slide regulation, the bolts 30 are moved forward/backward. When moving the bolts 30 forward/backward, no load acts on them. Thus, not only the operability is improved, but also the switching operation can be performed within a short period of time.

Figure 6:
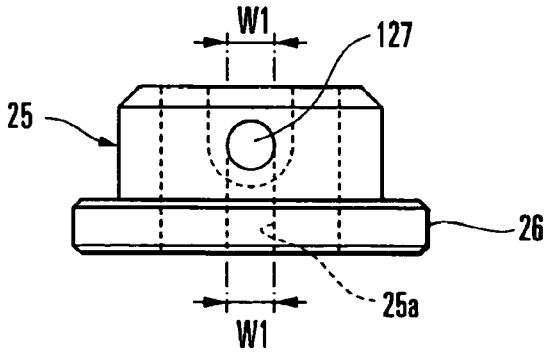
FIG. 6 is a view showing another example of the to-be-engaged member other than a U-groove.

In this embodiment, the to-be-engaged portion is a U-groove 27. Alternatively, the to-be-engaged portion may be a circular or elongated hole 127, as shown in FIG. 6. When the to-be-engaged portion is a circular hole, the to-be-engaged member 25 need be provided only at least at one end of the roller main body 20. Similarly, the U-groove 28 may be an elongated hole or circular hole.

In this embodiment, the ink form roller 15 which is in contact with the oscillating roller 14 has been described. The present invention can also be applied to a water form roller for the dampening unit 11. In this embodiment, the rotation and the motion in the axial direction of the ink form roller 15 are driven by the oscillating roller 14 which is in contact with the ink form roller 15. The present invention can also be applied to a structure in which the rotation of the form roller is driven by a motor.

As has been described above, according to the present invention, not only the operability is improved, but also the switching operation can be performed within a short period of time. Not only the operability of the switching operation of regulating the motion of the form roller in the axial direction can be improved, but also the operation can be performed smoothly within a short period of time.

What is claimed is:

1. A form roller apparatus for a printing press, comprising:

a form roller which is in contact with an oscillating roller and slides in an axial direction to follow motion of said oscillating roller in the axial direction, said form roller having a roller shaft which is supported rotatably and a roller main body which is supported to be movable in the axial direction of said roller shaft;

biasing means for biasing said roller main body in the axial direction;

a locking member which moves forward/backward in a radial direction at an end of said roller shaft; and a to-be-engaged portion which is provided to said roller main body and to be engaged by said locking member to regulate slide motion of said form roller in the axial direction.

2. An apparatus according to claim 1, wherein said locking member is a bolt which threadably engages with a screw hole formed in said roller shaft in the radial direction, and said to-be-engaged portion is a hole portion which is formed in said roller main body and is to be engaged by a distal end of said bolt.

3. An apparatus according to claim 2, wherein said roller main body has a guide groove which is formed in an axial direction thereof and through which the distal end of said bolt disengaged from the hole portion slides.

4. An apparatus according to claim 1, wherein said apparatus further comprises at least one to-be-engaged member which has said to-be-engaged portion and fits in an open end of said roller main body, and a slide motion of said form roller in the axial direction is regulated through said to-be-engaged member.

5. An apparatus according to claim 4, wherein said to-be-engaged member is constituted by a cylindrical portion through which said roller shaft extends and one end of which projects from the open end of said roller main body, and a flange integrally formed at the other end of said cylindrical portion and fitted in said roller main body.

6. An apparatus according to claim 5, wherein said cylindrical portion has a U-groove which opens to a projecting-side end, the U-groove forming said to-be-engaged portion that engages with a distal end of said locking member, said roller shaft has a screw hole corresponding to the U-groove, and when a slide motion of said form roller is regulated, said locking member extends through the screw hole and is positioned at a first position where a distal end thereof engages with the U-groove.

7. An apparatus according to claim 6, wherein when slide regulation of said form roller is to be canceled, said locking member extends through the screw hole, and is positioned at a second position where a distal end thereof does not to engage with the U-groove.

8. An apparatus according to claim 7, further comprising positioning means for selectively positioning said locking member at the first and second positions.

9. An apparatus according to claim 8, wherein said locking member has a rod-like shape formed of a small-diameter portion which is formed at a center in a longitudinal direction and which engages with said positioning means, a first positioning/engaging portion which is continuous to said small-diameter portion and a proximal end side and which has a diameter larger than that of said small-diameter portion, and a second positioning/engaging portion which is continuous to said small-diameter portion and a distal end side and which has a diameter larger than that of said small-diameter portion, when said positioning means engages with said first positioning/engaging means, said locking member is positioned at the first position, and when said positioning means engages with said second positioning/engaging portion, said locking member is positioned at the second position.

10. An apparatus according to claim 1, wherein said apparatus further comprises a pair of to-be-engaged members each of which has said to-be-engaged portion and which are fitted in openings at two ends of said roller main body; and a slide motion of said form roller in the axial direction is regulated through said pair of to-be-engaged members.

* * * * *